US007819703B1

(12) United States Patent
Walker et al.

(10) Patent No.: US 7,819,703 B1
(45) Date of Patent: Oct. 26, 2010

(54) ELECTRICAL CONNECTOR CONFIGURED BY WAFER HAVING COUPLING LEAD-FRAME AND METHOD FOR MAKING THE SAME

(75) Inventors: Kevin E. Walker, Hershey, PA (US); Terrance Little, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/386,782

(22) Filed: Apr. 22, 2009

(51) Int. Cl.
*H01R 24/00* (2006.01)

(52) U.S. Cl. ..... 439/676; 439/541.5; 439/540.1

(58) Field of Classification Search ..... 439/676, 439/941, 83, 540.1, 541.5
See application file for complete search history.

(56) References Cited

U.S. PATENT DOCUMENTS 5,547,405 A * 8/1996 Pinney et al. ..... 439/894
5,711,686 A * 1/1998 O'Sullivan et al. ..... 439/607.41
5,791,943 A 8/1998 Lo et al.
6,217,392 B1 * 4/2001 Chen ..... 439/676
6,413,121 B1 * 7/2002 Hyland ..... 439/676
6,447,341 B1 * 9/2002 Hyland ..... 439/676
6,488,544 B1 * 12/2002 Hyland ..... 439/676
6,506,080 B2 * 1/2003 Hyland ..... 439/676
6,612,876 B2 9/2003 Hyland
6,612,877 B2 * 9/2003 Hyland ..... 439/676
6,663,437 B2 * 12/2003 Korsunsky et al. ..... 439/676
6,863,575 B2 3/2005 Hyland
6,896,557 B2 * 5/2005 Aekins et al. ..... 439/676
6,916,209 B1 * 7/2005 Casher et al. ..... 439/676
7,238,060 B1 * 7/2007 Lee et al. ..... 439/676
7,575,483 B1 * 8/2009 Zhang ..... 439/676

* cited by examiner

*Primary Examiner*—T C Patel
*Assistant Examiner*—Harshad C Patel
(74) *Attorney, Agent, or Firm*—Ming Chieh Chang; Wei Te Chung; Andrew C. Cheng

(57) ABSTRACT

An electrical connector (100) includes an insulative housing (40) and a terminal module (10) retained in the insulative housing and configured with a selected terminal (11), a determined terminal (12) and a specific terminal (13) molded within a dielectric wafer (2). A coupling lead-frame (3) is disposed onto a surface of the dielectric wafer and has its main portion (3*a*) parallel and aligned with the specific terminal. The coupling lead-frame includes one pin leg (311) crossing over the determined terminal and having a physical and electrical engagement with the selected terminal so as to establish an electrical coupling between the selected terminal and the specific terminal.

14 Claims, 12 Drawing Sheets

ELECTRICAL CONNECTOR CONFIGURED BY WAFER HAVING COUPLING LEAD-FRAME AND METHOD FOR MAKING THE SAME

BACKGROUND OF THE INVENTION

1. Field of the Invention

The present invention relates to an RJ modular jack, and particularly, to an RJ modular jack configured by a wafer on which coupling traces are provided so as to create electrical coupling between selected terminals disposed within the wafer.

2. Description of Related Art

To comply with a high speed trend of data transmission, electrical devices are required to have better performance. Performance requirements have significantly increased to a level identified by industry standards as Category 5. The Telecommunications Industry Association (TIA) in corporation with the Electronic Industries Association (EIA) has developed a proposed standard for Category 5 components. In such high speed applications, electrical coupling between adjacent terminals would create a great problem. Unless the electrical coupling between the terminals could be controlled effectively within the connector to an accepted level, it is highly unlikely that the connector can be used for long time.

U.S. Pat. No. 6,447,341 issued to Hyland on Sep. 10, 2002 discloses an RJ modular connector comprising a housing and a terminal insert received in the housing. The terminal insert includes a pair of wafers, a plurality of conductive traces formed on an inner surface of the wafer, and a plurality of terminals sandwiched between the pair of wafers. One conductive trace of the plurality of traces has a body portion aligned with one selected terminal and a connection portion fanning out from the body portion and disposed below a specific terminal for aligning with the specific terminal for electrically connecting with the specific terminal. Therefore, an electrical coupling between the selected terminal and the specific terminal is established. The connection portions of the conductive traces are distributed along an outer side of the body portions.

The electrical connection between the connection portion and the specific terminal is not reliable enough, by disposing the connection portion below the specific terminal. Therefore, the electrical coupling between the selected terminal and the specific terminal is simultaneously unreliable. Additionally, outwardly extending connection portions would occupy the extra space of the wafer and enlarge the length of the wafer.

U.S. Pat. No. 5,791,943 issued to Lo et al. on Aug. 11, 1998 discloses a modular outlet issued to Lo et al. comprises a housing supporting a plurality of contacts and a termination cap mated to the housing for terminating a plurality of wires at one end of the contacts. The contacts are positioned on a contact carrier received in the housing. The contacts include stacked current carrying plates to induce capacitance between the selected contacts. The method of achieving a controlled amount of capacitive coupling between selected contacts allows the modular outlet to meet or exceed Category 5 requirements. The insulation displacement contacts are sequentially positioned.

The contacts have connecting portions inserted into the housing for contact with the circuit traces. It is easy to distort the connecting portions of the contacts and thus it would result in unreliable electrical compensation between the contacts and the circuit traces.

Hence, an improved electrical connector is required to overcome the above-mentioned disadvantages of the related art.

SUMMARY OF THE INVENTION

A primary object of the present invention is to provide an electrical connector capable of achieving reliable electrical coupling among the terminals.

To achieve the aforementioned object, an electrical connector includes an insulative housing and a terminal module retained in the insulative housing and configured with a selected terminal, a determined terminal and a specific terminal molded within a dielectric wafer. A coupling lead-frame is disposed onto a surface of the dielectric wafer and has its main portion parallel and aligned with the specific terminal. The coupling lead-frame includes one pin leg crossing over the determined terminal and having a physical and electrical engagement with the selected terminal so as to establish an electrical coupling between the selected terminal and the specific terminal.

The coupling lead-frame has a plurality of pin legs formed thereon for providing access to the terminals, to thereby establish a reliable electrical connection between the terminals and the coupling lead-frame. Therefore, the electrical compensation among the terminals is reliable.

Other objects, advantages and novel features of the invention will become more apparent from the following detailed description of a preferred embodiment when taken in conjunction with the accompanying drawings.

DETAILED DESCRIPTION OF THE INVENTION

Figure 1:
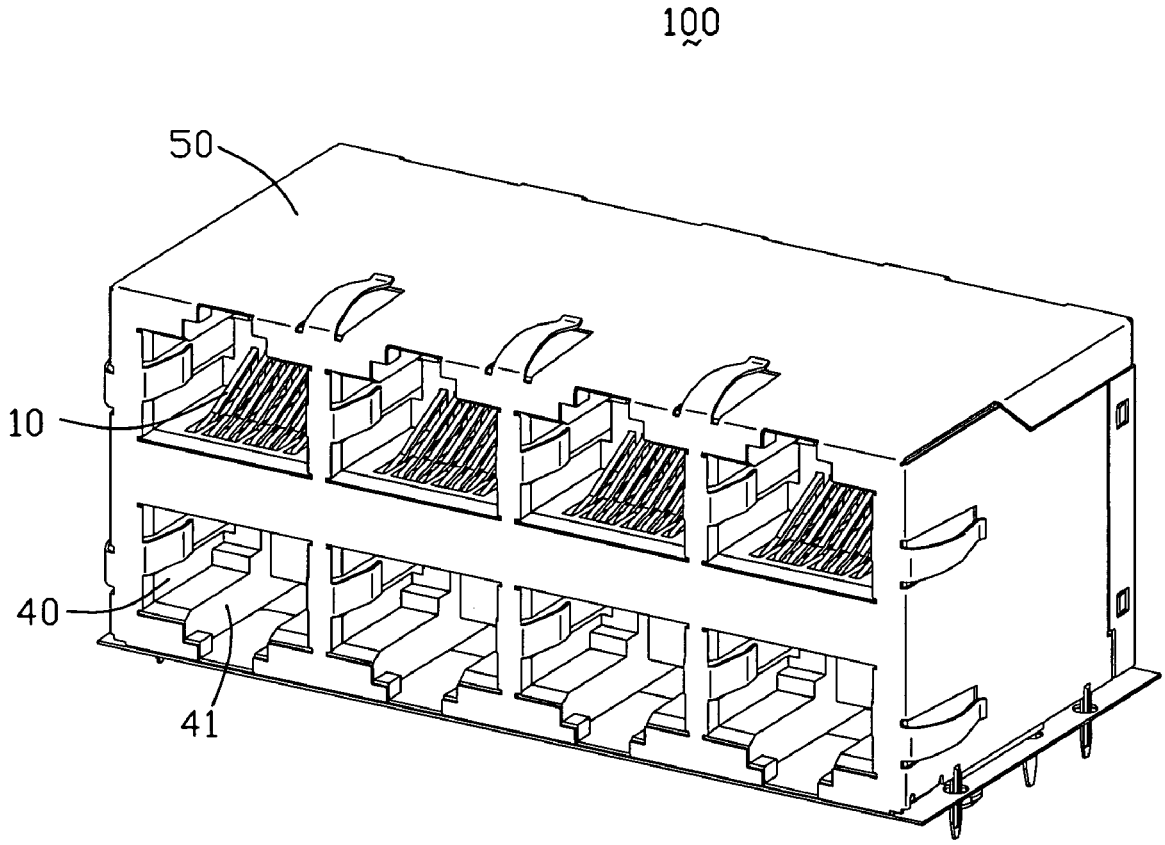
FIG. 1 is an assembled perspective view of an electrical connector in accordance with the embodiment of the present invention.

Reference will now be made to the drawing figures to describe the present invention in detail. Referring to FIG. 1, an electrical connector 100 in accordance with the preferred embodiment of the present invention comprises an insulative housing 40 defining a plurality of cavities 41, a plurality of terminal modules 10 received in the cavities 41, and a shielding shell 50 attached to the insulative housing 40. In another embodiment, the terminal module 10 could be applied in other structure.

Figure 2:
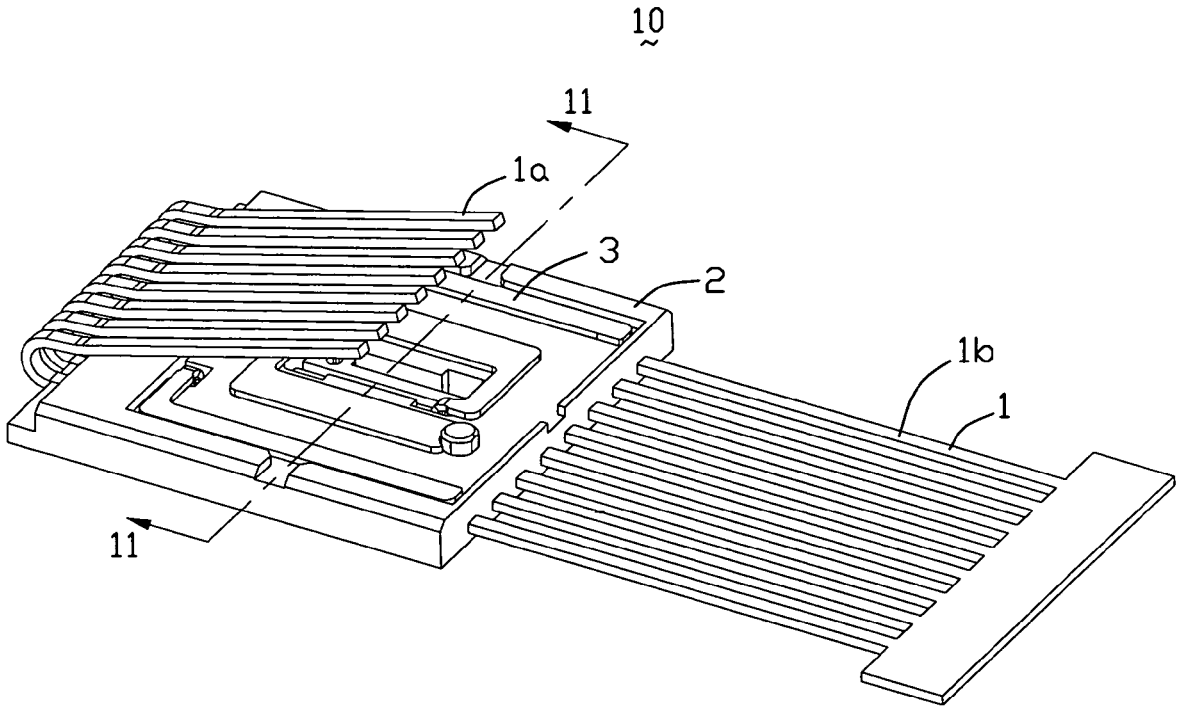
FIG. 2 is an assembled perspective view of a terminal module as shown in FIG. 1.

Referring to FIG. 2, each terminal module 10 comprises a coupling lead-frame 3, a dielectric wafer 2 and a plurality of terminals 1. The dielectric wafer 2 in accordance with the present invention is configured by insert-molding the terminals 1, typically eight, altogether, i.e., first through eighth terminals 11-18. According to the certain application, electrical couplings are respective produced between first and the third terminals 11 and 13, the third and fifth terminals 13 and 15, the fourth and sixth terminals 14 and 16, the sixth and eighth terminals 16 and 18.

Figure 4:
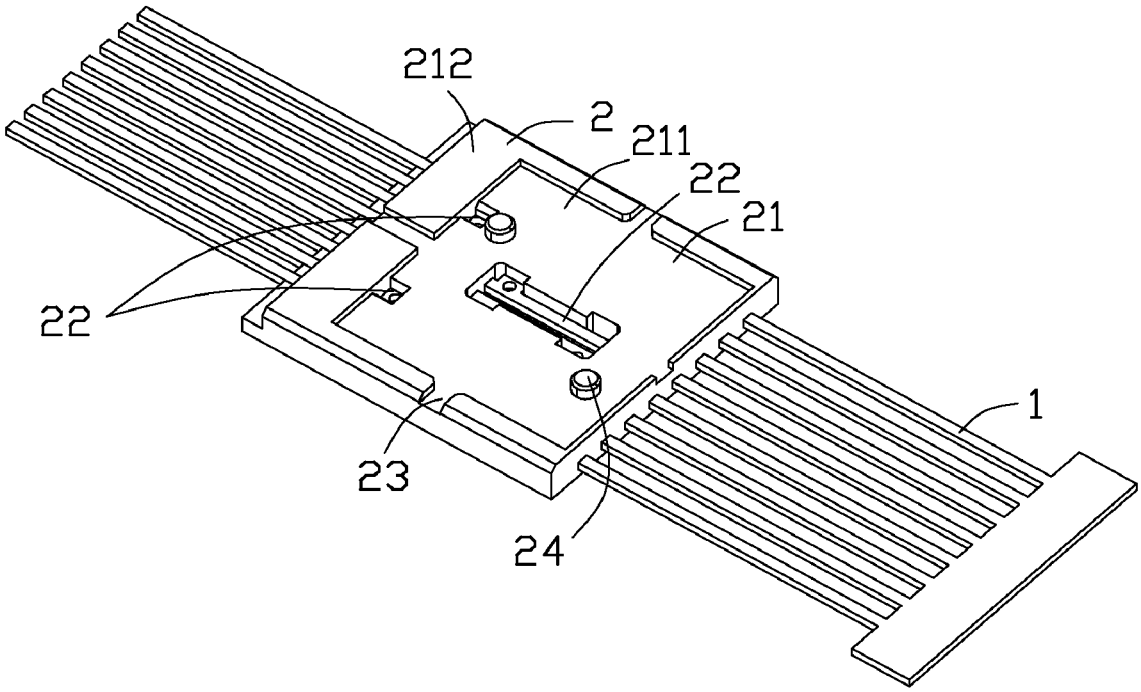
FIG. 4 is a perspective view showing the terminals insert molded in the dielectric wafer.
Figure 10:
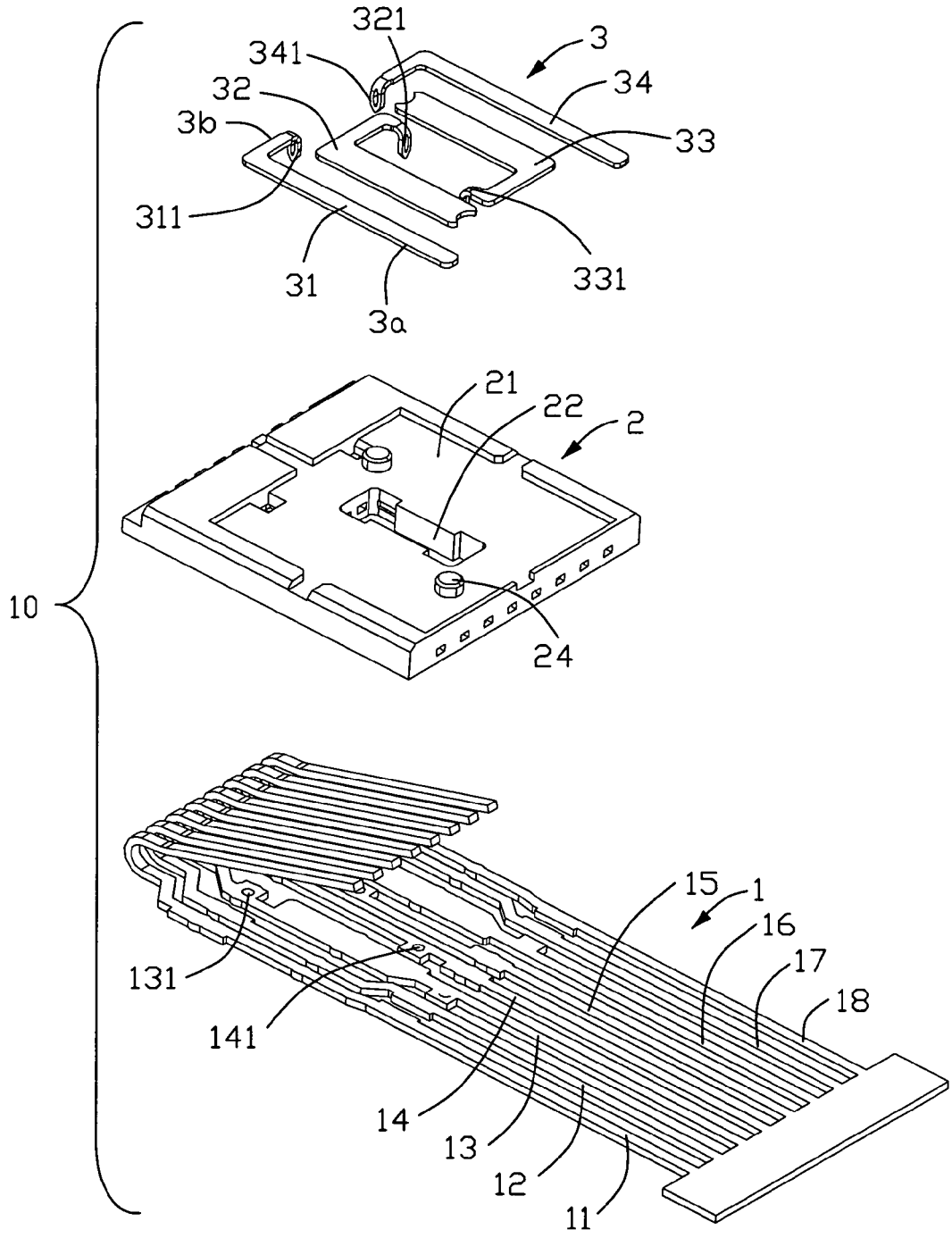
FIG. 10 is an exploded view of the terminal module as shown in FIG. 2.
Figure 11:
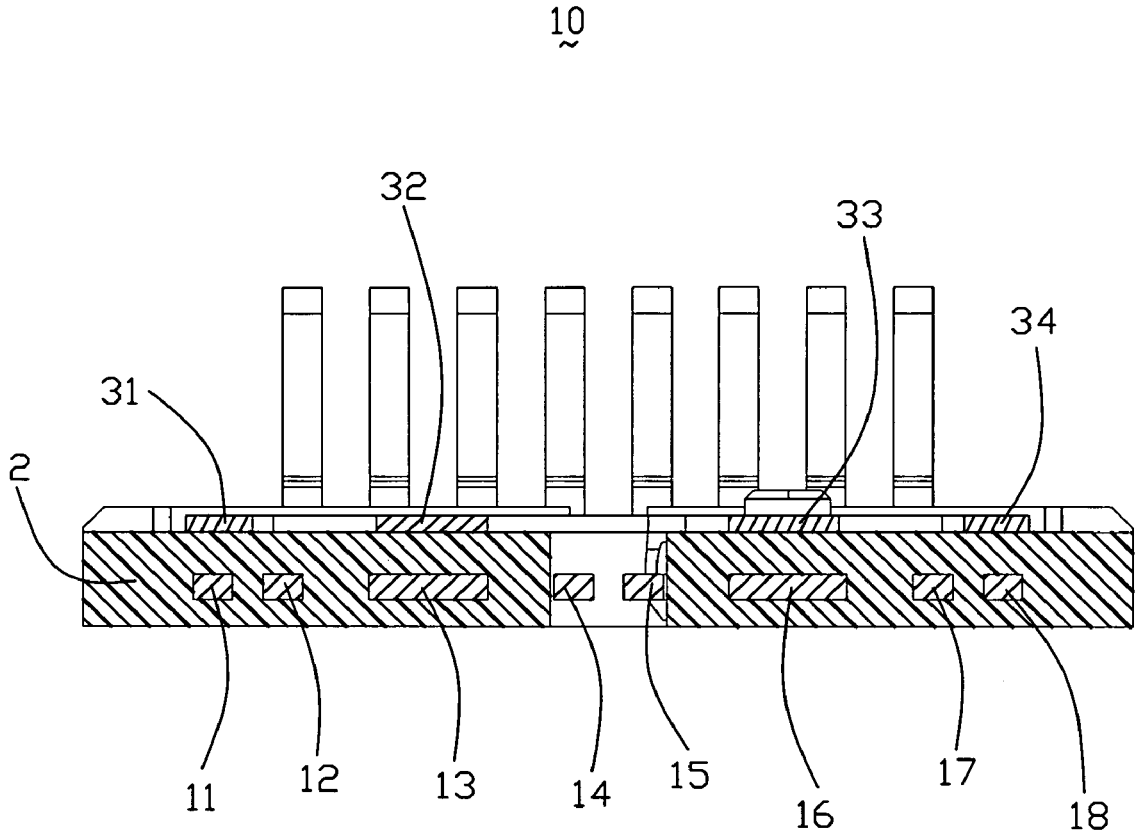
FIG. 11 is a cross-sectional view of the terminal module as shown in FIG. 2, taken along line 11-11.
Figure 12:
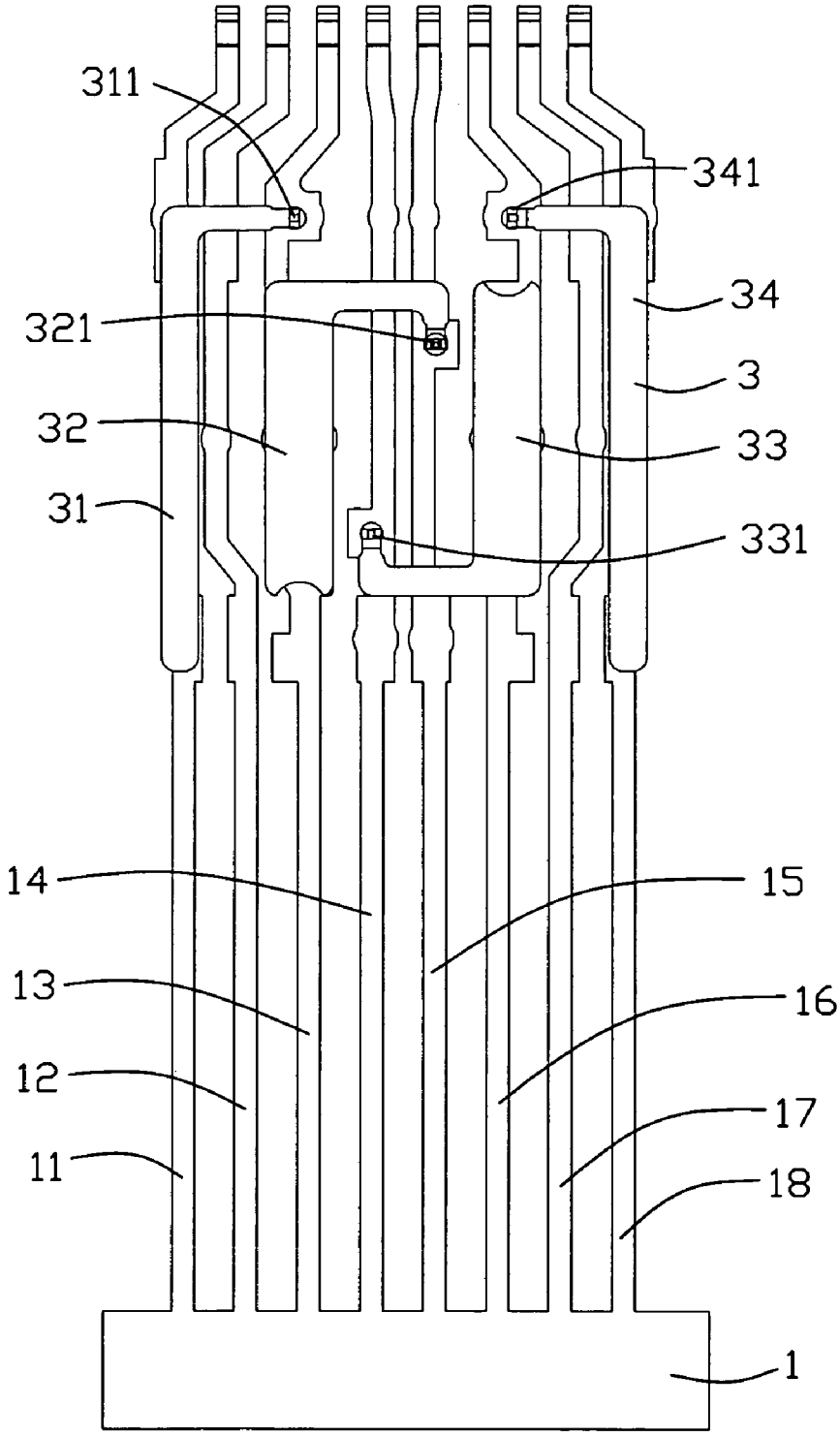
FIG. 12 is a top view showing the disposition of the circuit traces and the terminals.

After the dielectric wafer 2 is molded the eight terminals 11-18, a flat upper surface is provided, and see FIG. 4. In conjunction with FIGS. 10-12, in order to create an electrical coupling between the first and third terminals 11 and 13, a first circuit trace 31 is provided and lying substantially over the first terminal 11 with its body portion 3*a*. The first circuit trace 31 includes one beams 3*b* crossing over the second terminal 12 and finally physically and electrically engaged with the third terminal 13. According to a preferred embodiment, the beam 3*b* is provided with a needle eye arrangement (not labeled) so as to press-fit into the third terminal 13 in which corresponding third pinhole 131 is provided. The dielectric wafer 2 is also provided with through hole corresponding to the third pinhole 131 such that the third pinhole 131 can readily pass through and make an interferential engagement. In this arrangement, the first terminal 11 could be regarded as a specific terminal, the third terminal 13 could be regarded as a selected terminal, and the second terminal 12 could be regarded as a determined terminal.

In conjunction with FIGS. 9-12, in order to create an electrical coupling between the third and fifth terminals 13 and 15, a second circuit trace 32 is provided and lying substantially over the third terminal 13 with its body portion 3*a*. The beam 3*b* of the second circuit trace 32 crosses over the second terminal 12 and finally physically and electrically engaged with the fourth terminal 14. According to the preferred embodiment, the beam 3*b* is provided with needle eyes arrangement so as to press-fit into the fifth terminal 15 in which corresponding fifth pinhole 151 is provided. The dielectric wafer 2 is also provided with through holes corresponding to the fifth pinhole 151 such that the fifth pinhole 151 can readily pass through and make an interferential engagement. In this arrangement, the third terminal 13 could be regarded as a specific terminal, the fifth terminal 15 could be regarded as a selected terminal, and the fourth terminal 14 could be regarded as a determined terminal.

In order to create an electrical coupling between the fourth and sixth terminals 14 and 16, a third circuit trace 33 is provided and lying substantially over the fourth terminal 14 with its body portion 3*b*. The beam 3*b* of the third circuit trace 33 crosses over the fifth terminal 15 and finally physically and electrically engaged with the fourth terminal 14. According to the preferred embodiment, the third compliant pin 331 is provided with needle eyes arrangement (not labeled) so as to press-fit into the fourth terminal 14 in which corresponding fourth pinhole 141 is provided. The dielectric wafer 2 is also provided with through holes corresponding to the fourth pinhole 141 such that the fourth pinhole 141 can readily pass through and make an interferential engagement. In this arrangement, the sixth terminal 16 could be regarded as a specific terminal, the fourth terminal 14 could be regarded as a selected terminal, and the fifth terminal 15 could be regarded as a determined terminal.

In order to create an electrical coupling between the sixth and eighth terminals 16 and 18, a fourth circuit trace 34 is provided and lying substantially over the eighth terminal 18 with its body portion 3*a*. The beam 3*b* of the fourth circuit trace 34 crosses over the seventh terminal 17 and finally physically and electrically engaged with the sixth terminal 16. According to the preferred embodiment, the fourth compliant pin 341 is provided with a pair of needle eyes arrangement (not labeled) so as to press-fit into the sixth terminal 16 in which corresponding sixth pinhole 161 are provided. The dielectric wafer 2 is also provided with through hole corresponding to the sixth pinhole 161 such that the sixth pinhole 161 can readily pass through and make an interferential engagement. The crosstalk compensation scheme among the terminals 11-18 has been reduced. In this arrangement, the eighth terminal 18 could be regarded as a specific terminal, the sixth terminal 16 could be regarded as a selected terminal, and the seventh terminal 17 could be regarded as a determined terminal.

Figure 3:
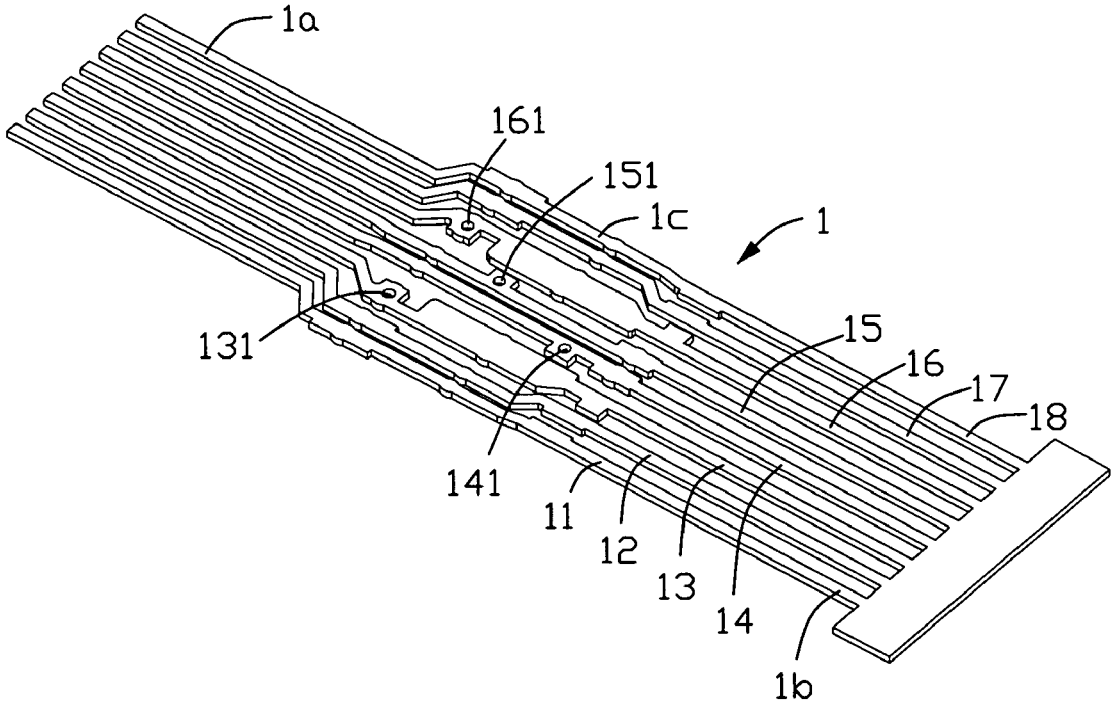
FIG. 3 is a perspective view showing a plurality of terminals as shown in FIG. 2, when the terminals has not been insert molded in a dielectric wafer.

Referring to FIG. 3, the plurality of terminals 1 are stamped with electrical coupling reduction capacitive plates. The first through eighth terminals 11-18 are substantially parallel with each other and arranged in sequence. The fifth through eighth terminals 15-18 are substantially symmetrically arranged relative to the first through fourth terminals 11-14. The first through eighth terminal 11-18 has a first through eighth primary end 1*a*, a first through eighth tail end 1*b*, and a first through eighth intermediate portion 1*c* between the primary end 1*a* and the tail end 1*b*. The intermediate portion 1*c* of the third terminal 13 defines a third pinhole 131 defined. The intermediate portion 1*c* of the fourth terminal 14 has a fourth pinhole 141 defined thereon. The intermediate portions 1*c* of the fifth terminal 15 and the sixth terminal 16 respectively have the fifth pinhole 151 and the sixth pinhole 161 defined symmetrically to the fourth pinhole 141 and the third pinhole 131.

Figure 8:
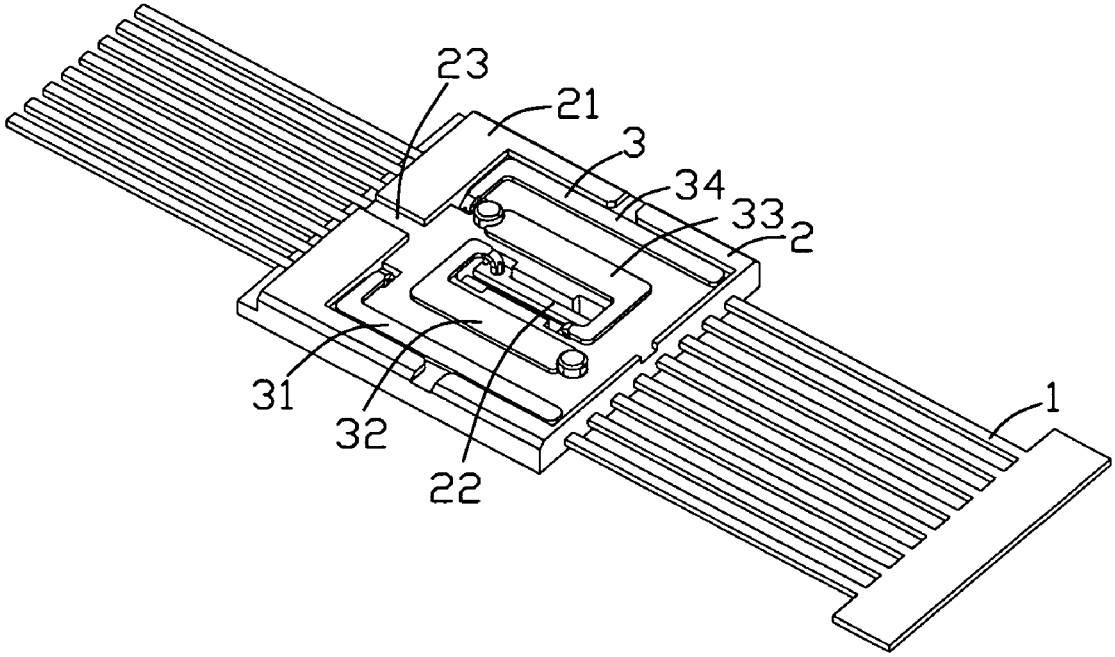
FIG. 8 is a perspective view similar to FIG. 7, when the carrier strip has been trimmed away.
Figure 9:
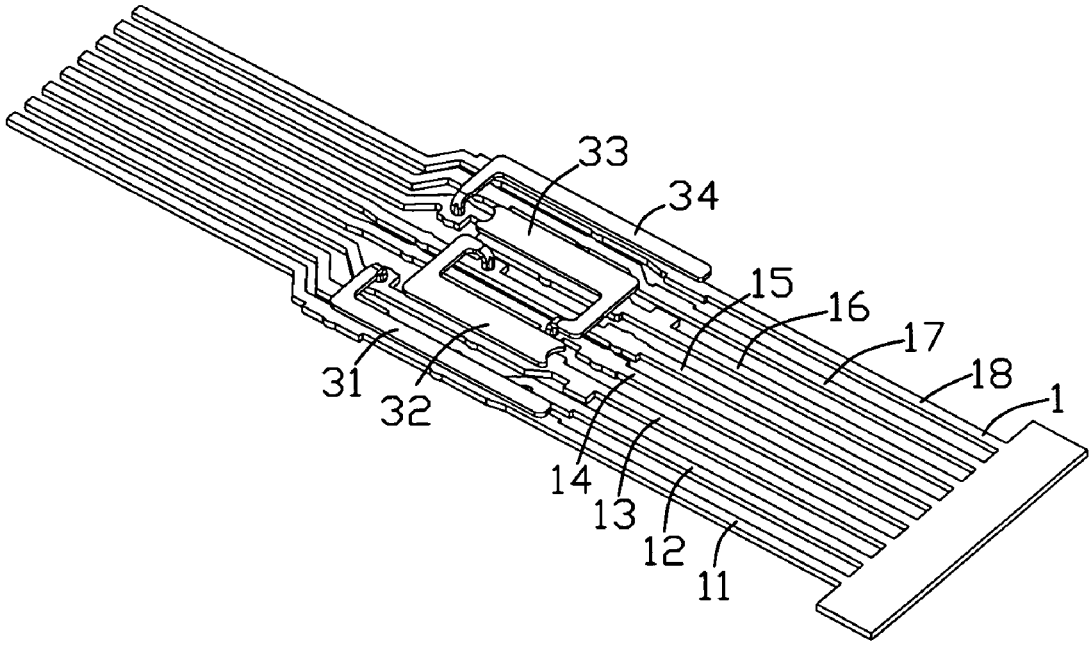
FIG. 9 is a schematic perspective view showing the connection between the terminals and the circuit traces of the coupling lead-frame.

Referring to FIGS. 4 and 8, the dielectric wafer 2 is made from dielectric material and comprises a rectangular base portion 21. A top surface of the base portion 21 has a concave portion 211 defined in a center portion thereof and a plurality of flanges 212 formed along side edges of the base portion 21 for surrounding the concave portion 211. The flanges 212 have four recesses 23 defined at middle portion of the four side edges of the base portion 21 and communicating with the concave portion 211 for extension of carrier strip of the coupling lead-frame 3. The concave portion 211 has a plurality of windows 22 defined at proper positions for exposing the third through sixth pinholes 131-161 of the terminal module 10. The windows 22 defined in the base portion 21 are performed as air pocket for impedance control. The dielectric wafer 2 has a plurality of posts 24 formed in the concave portion 211.

Figure 5:
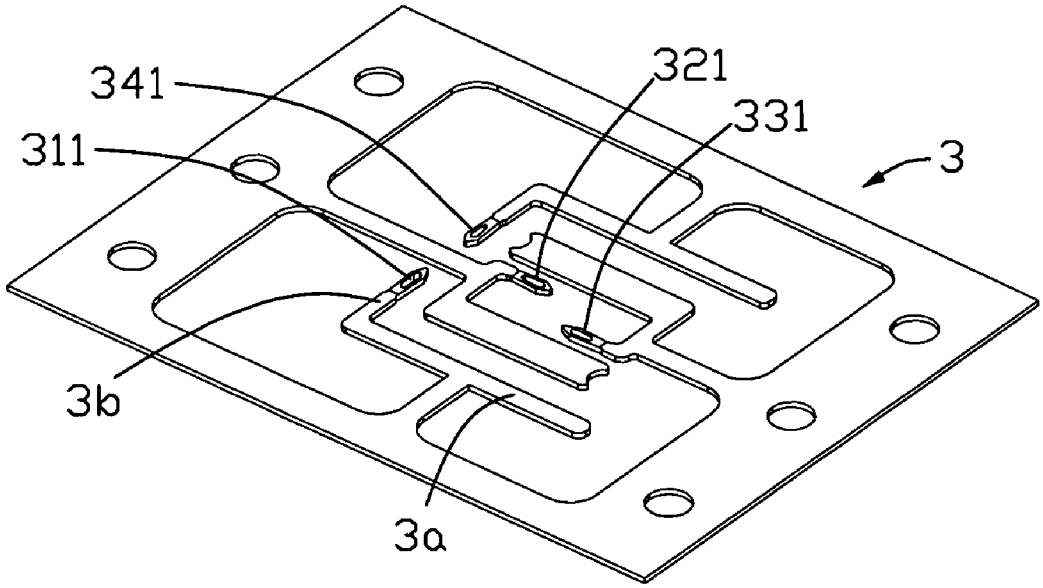
FIG. 5 is a perspective view showing a coupling lead-frame as shown in FIG. 2, when the coupling lead-frame has not been embed stamped in the dielectric wafer.
Figure 6:
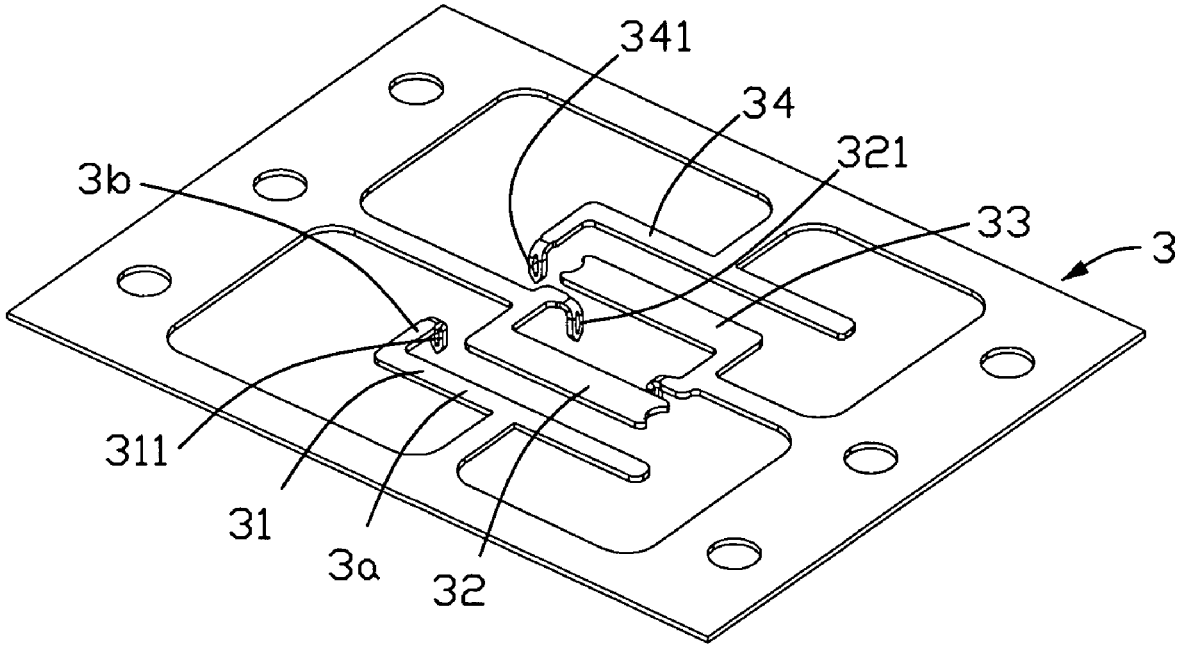
FIG. 6 is a perspective view similar to FIG. 5, when the compliant pins has been bent vertically.

Referring to FIGS. 5 and 6, the coupling lead-frame 3 is made of punched thin metal to establish a foil-like structure. The coupling lead-frame 3 comprises a first through fourth circuit traces 31-34 formed in coplanar fashion and arranged in sequence. The first through fourth circuit traces 31-34 are interconnected together with a carrier strip. Each circuit trace 31-34 has the lengthwise extending body portion 3*a*. The first circuit trace 31 is provided with one beam 3*b* perpendicular to the body portion 3*a* and a first compliant pin 311 formed at the free end of the beam 3*b*. The second circuit trace 32 has a beam 3*b* connected to the body portion 3*a* and a second compliant pin 321 formed at the free end of the beam 3*b*. The second circuit trace 32 has another end opposite to the beam 3*b* resisted against to the post 24 of the dielectric wafer 2. The third and the second circuit traces 33, 32 are configured in mirror image, while the fourth and the first circuit traces 34, 31 are configured in mirror image. The third and the fourth circuit traces 33, 34 respective have the third and fourth compliant pins 331, 341 similar to the second and the first compliant pins 321, 311.

Referring to FIG. 4, in manufacturing of the terminal module 10, firstly, providing a set of terminals stamping from a metal sheet. According to the preferred embodiment, the third terminal 13 and sixth terminal 16 are both provided with an enlarged portion (not labeled) for electrically coupling. Among the first through eighth terminals 11-18, the first and third terminals 11 and 13, the third and fifth terminals 13 and 15, the fourth and sixth terminals 14 and 16, the sixth and eighth terminals 16 and 18, need electrical coupling therebetween.

Figure 7:
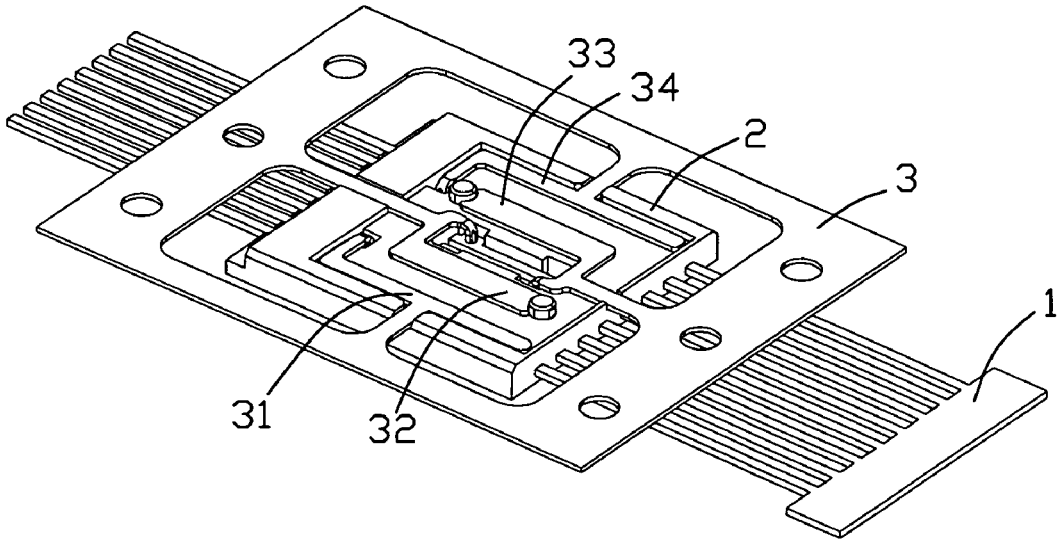
FIG. 7 is an assembled perspective view showing the terminals and the coupling lead-frame assembled to the dielectric wafer, when the carrier strip has not been trimmed away.

Referring to FIGS. 6-7, secondly, providing a dielectric wafer 2 having an upper surface and insert-molding the eight terminals 11-18 into the dielectric wafer 2. The windows 22 of the dielectric wafer 2 are aligned with the third through sixth pinholes 131-161 for exposing corresponding pinholes 131-161.

Thirdly, providing a set of circuit traces 31-34 which are corresponding to those selected terminals 13-16. Each of the circuit traces 31, 32, 33 and 34 are provided with complaint pins 311-341 for electrically and physically engagement with the selected terminals 13-16.

Fourthly, embed-stamping the first through fourth circuit traces 31-34 onto the upper surface of the dielectric wafer 2 such that the complaint pins 311-341 are physically and electrically engaged with the selected terminals 13-16. The first through fourth circuit traces 31-34 are retained in the concave portion 211 of the dielectric wafer 2. In conjunction with FIG. 9, the downwardly bent first through fourth compliant pins 311-341 are inserted through corresponding windows 22 into the third through sixth pinholes 131-161 and electrically connected with the third through sixth terminals 13-16. The carrier strip of the coupling lead-frame 3 extends outwardly through the recesses 23. Next, in conjunction with FIG. 8, cut down and trim away redundant carrier strip of the coupling lead-frame 3 to separate the first through fourth circuit traces 31-34 from each other.

As the imbed-stamping occurs, the soft nature of the dielectric wafer 2 will conform around the profile of the stamping as it is pressed below the surface of the dielectric wafer 2. Thereby, the compensation stamping will not come out of the dielectric wafer 2.

Referring to FIG. 8, the first and fourth circuit traces 31 and 34 are extending along an outer side of the concave portion 211 of the dielectric wafer 2 to define a region (not labeled) surrounded by the first and the fourth circuit traces 31, 34. The first through fourth compliant pins 311-341 are restricted within the region. The compliant pins 311-341 would not occupy extra space outside the region. Thus, it would not enlarge the length of the dielectric wafer 2.

The terminals 1 are insert molded within the dielectric wafer 2 as a solid structure, with the first through fourth compliant pins 311-341 inserted into the third through sixth pinholes 131-161 of the third through sixth terminals 13-16 for electrically connecting the coupling lead-frame 3 with corresponding terminals 1. Optionally, the terminals 1 could be assembled into the dielectric wafer 2 by other methods. It is easy for assembly of the terminals 1. It is provided with necessary dielectric between the capacitive plates within the terminals 1.

Referring to FIG. 6, the primary ends 1*a* of the first through eighth terminals 11-18 tilt upwardly to form as contact portions. The tail ends 1*b* are bent downwardly for soldering onto a circuit board (not shown).

The coupling lead-frame 3 has a plurality of discrete compliant pins 311-341 formed thereon for providing access to the molded pinholes 131-161 of the terminals, to thereby establish a reliable electrical connection between the terminals 1 and the coupling lead-frame 3. Therefore, the electrical compensation among the terminals 1 is reliable.

However, the disclosure is illustrative only, changes may be made in detail, especially in matter of shape, size, and arrangement of parts within the principles of the invention.

What is claimed is:

1. An electrical connector, having a terminal module with coupling compensation, and comprising:

an insulative housing defining a mating interface for receiving a plug therein; and said terminal module retained in the insulative housing and with mating contact extending into the mating interface, and configured with a selected terminal, a determined terminal and a specific terminal molded within a dielectric wafer having a surface, at least one coupling lead-frame disposed onto said surface of the dielectric wafer and having its main portion parallel and aligned with the specific terminal, the coupling lead-frame comprising one beam crossing over the determined terminal and having a physical and electrical engagement with the selected terminal so as to establish an electrical coupling between the selected terminal and the specific terminal, wherein said specific terminal is shrouded by the dielectric wafer all around; and wherein said dielectric wafer comprises a base portion defining a plurality of windows exposing the pinhole of a specific terminal, and pin leg of a coupling lead-frame inserted into the pinhole of the specific terminal via corresponding window.

2. The electrical connector as claimed in claim 1, wherein said coupling lead-frame comprises a plurality of circuit traces each having a body portion connected with the beam, the beams of the circuit traces of the coupling lead-frame restricted within a region surrounded by the body portions of the circuit traces.

3. The electrical connector as claimed in claim 1, wherein said specific terminal is formed with one pinhole for insertion of the beam of the coupling lead-frame.

4. The electrical connector as claimed in claim 1, wherein said dielectric wafer is made from dielectric material, said windows performed as air pocket within the dielectric material.

5. The electrical connector as claimed in claim 2, wherein said terminal module is configured with a first through eighth terminals substantially parallel with each other and arranged in sequence and containing the selected terminal, the determined terminal and the specific terminal, and wherein said coupling lead-frame comprises a first through fourth circuit traces.

6. The electrical connector as claimed in claim 5, wherein said selected terminal is the first terminal aligned with the first circuit trace, and wherein said determined terminal is the second terminal and the specific terminal is the third terminal.

7. The electrical connector as claimed in claim 5, wherein said selected terminal is the third terminal aligned with the second circuit trace, and wherein said determined terminal is the fourth terminal and the specific terminal is the fifth terminal.

8. The electrical connector as claimed in claim 5, wherein said selected terminal is the sixth terminal aligned with the third circuit trace, and wherein said determined terminal is the fifth terminal and the specific terminal is the fourth terminal.

9. The electrical connector as claimed in claim 5, wherein said selected terminal is the eighth terminal aligned with the fourth circuit trace, and wherein said determined terminal is the seventh terminal and the specific terminal is the sixth terminal.

10. A method, for establishing an electrical connection between two selected terminals within an RJ connector, comprising the steps of:

providing an insulative housing defining a mating interface for receiving a plug therein;

providing a terminal module received in the housing and with mating contact extending into the mating interface, and configured with first, second and third terminals side by side mounted within a dielectric wafer having a surface, by insert-molding;

providing at least one coupling lead-frame disposed onto said surface of the dielectric wafer and having its main portion horizontally parallel to and vertically aligned to the third terminal, the coupling lead-frame including one beam crossing over the second terminal and having a physical and electrical engagement with the first terminal so as to establish an electrical coupling between the first and third terminal; and wherein said coupling lead-frame is formed by a punched thin metal to establish a foil-like structure having a plurality of circuit traces interconnected with each other via a carrier strip and the beam coplanar to the body portion initially, and wherein said beam is bent vertically toward the terminal prior to imbed-stamping the coupling lead-frame into the dielectric wafer.

11. The method as claimed in claim 10, wherein said third terminal defines pinholes for insertion of beam of the coupling lead-frame.

12. The method as claimed in claim 11, wherein said dielectric wafer defines a concave portion for retaining the circuit traces of the coupling lead-frame and a plurality of recesses communicating with the concave portion for extension of the carrier strip of the coupling lead-frame prior to the assembly of the terminal module.

13. The method as claimed in claim 12, wherein said strip carrier has been cut down and trimmed away after the coupling lead-frame has been imbed-stamped in the dielectric wafer.

14. The method as claimed in claim 12, wherein said concave portion of the dielectric wafer defines a plurality of windows for exposing the pinhole of the third terminal prior to the assembly of the terminal module.

* * * * *